US010844699B2

(12) United States Patent
Xiao et al.

(10) Patent No.: US 10,844,699 B2
(45) Date of Patent: Nov. 24, 2020

(54) BY-PASS SYSTEM AND METHOD FOR INVERTED ESP COMPLETION

(71) Applicant: Saudi Arabian Oil Company, Dhahran (SA)

(72) Inventors: Jinjiang Xiao, Dhahran (SA); Rafael Adolfo Lastra, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 242 days.

(21) Appl. No.: 15/991,824

(22) Filed: May 29, 2018

(65) Prior Publication Data

US 2019/0368291 A1 Dec. 5, 2019

(51) Int. Cl.
*E21B 43/12* (2006.01)

(52) U.S. Cl.
CPC ..... *E21B 43/128* (2013.01)

(58) Field of Classification Search
CPC ..... E21B 43/128
See application file for complete search history.

(56) References Cited

U.S. PATENT DOCUMENTS 6,119,780 A 9/2000 Christmas
6,325,143 B1 12/2001 Scarsdale
6,497,278 B1 12/2002 Norris
6,964,299 B2 11/2005 Scarsdale
7,231,978 B2 6/2007 Rivas et al.
7,487,838 B2 2/2009 Knight et al.
8,316,938 B2 11/2012 Al-Jarri et al.
2006/0196660 A1 9/2006 Patel
2009/0200034 A1 8/2009 Leitch
2015/0041126 A1 2/2015 Boyle et al.

OTHER PUBLICATIONS

International Search Report and Written Opinion for related PCT application PCT/US2019/034211 dated Sep. 6, 2019.

*Primary Examiner* — Robert E Fuller
(74) *Attorney, Agent, or Firm* — Bracewell LLP; Constance G. Rhebergen; Linda L. Morgan

(57) ABSTRACT

A system for providing artificial lift to wellbore fluids has a pump located within a wellbore and a motor located within the wellbore uphole of the pump. A seal assembly has a first side connected to the motor and a second side connected to the pump. The pump, motor, and seal assembly together form a submersible pump string. An uphole packer circumscribes the production tubular uphole of the motor. A downhole packer is located downhole of the pump. An uphole y-tool has an uphole y-tool first end in fluid communication with the production tubular and an uphole y-tool second end with a first uphole y-tool branch that is mechanically connected to the submersible pump string and a second uphole y-tool branch in fluid communication with a bypass tubular. The bypass tubular is positioned adjacent to the submersible pump string and extends between the uphole y-tool and the downhole packer.

14 Claims, 4 Drawing Sheets

BY-PASS SYSTEM AND METHOD FOR INVERTED ESP COMPLETION

BACKGROUND OF THE DISCLOSURE

1. Field of the Disclosure

The present disclosure relates to electrical submersible pumps used in hydrocarbon development operations, and more specifically, the disclosure relates to inverted electrical submersible pump completions with by-pass capabilities.

2. Description of the Related Art

In hydrocarbon developments, it is common practice to use electric submersible pumping systems (ESPs) as a primary form of artificial lift. However, with an ESP installed at an end of the production tubing, access to the reservoir downhole of the ESP is blocked. Reservoir access is often required to add additional perforations to provide fluid communication between the wellbore and the reservoir, to perform reservoir treatments such as acidizing or scale removal, or to run specialized logging tools on coil tubing or wireline, such as for the identification of water or oil zones within the reservoir. Therefore, frequent reservoir access may be required with the ESP in place.

SUMMARY OF THE DISCLOSURE

A y-tool can be utilized with a conventional ESP where the pump of the ESP is located uphole of the motor. A y-tool is a completion tool that allows for reservoir access when an ESP system is used. A y-tool can have a shape of an inverted letter "Y" to split a flow path into two branches. When used with an ESP, one branch of the y-tool can be used to hang the ESP system and the other branch can allow access to the reservoir.

However, current systems do not allow for a y-tool to be utilized with an inverted ESP system where the motor is uphole of the pump. If a currently available y-tool is used with a currently available inverted ESP system fluid recirculation between the pump intake and pump discharge will occur, which will lead to motor overheating and premature failure of the ESP system. Systems and methods of this disclosure provide embodiments of a well completion with an inverted ESP that allows for access to the reservoir downhole of the ESP. Embodiments of this disclosure allow for logging, stimulation and other well interventions to be undertaken downhole of the ESP within the well without having to retrieve the ESP from the well.

In an embodiment of this disclosure, a system for providing artificial lift to wellbore fluids has a pump located within a wellbore. The pump is oriented to selectively boost a pressure of the wellbore fluids traveling from the wellbore towards an earth's surface through a production tubular. A motor is located within the wellbore uphole of the pump and provides power to the pump. A seal assembly has a first side connected to the motor and a second side connected to the pump. The pump, the motor, and the seal assembly together form a submersible pump string. An uphole packer circumscribes the production tubular uphole of the motor. A downhole packer is located within the wellbore downhole of the pump. An uphole y-tool has an uphole y-tool first end in fluid communication with the production tubular and an uphole y-tool second end with two uphole y-tool branches. A first uphole y-tool branch of the two uphole y-tool branches is mechanically connected to the submersible pump string and a second uphole y-tool branch of the two uphole y-tool branches is in fluid communication with a bypass tubular. The bypass tubular is positioned adjacent to the submersible pump string and extends between the uphole y-tool and the downhole packer.

In alternate embodiments, a central bypass axis of the bypass tubular can be aligned with an inner bore of the production tubular. The downhole packer can circumscribe the bypass tubular.

In other alternate embodiments, the system can further include a downhole y-tool, where the downhole y-tool is located downhole of the submersible pump string and uphole of the downhole packer. The downhole y-tool can have a downhole y-tool first end in fluid communication with the bypass tubular and a downhole y-tool second end with two downhole y-tool branches, where a first downhole y-tool branch of the two downhole y-tool branches is in fluid communication with the submersible pump string and a second downhole y-tool branch of the two downhole y-tool branches is in fluid communication with the bypass tubular. The second downhole y-tool branch of the downhole y-tool can have a plug seat with a seat surface facing in a direction towards the submersible pump string.

In yet other alternate embodiments, the downhole packer can be a single bore packer. Alternately, the downhole packer can be a dual bore packer and the downhole packer can circumscribe a pump intake that is in fluid communication with the submersible pump string. A flow crossover can be located uphole of the motor and downhole of the uphole y-tool. The flow crossover can have a fluid flow path from the wellbore between the uphole packer and the downhole packer and the first uphole y-tool branch.

In other embodiments of this disclosure, a system for providing artificial lift to wellbore fluids has an uphole packer sealing around an inner diameter surface of a wellbore. A downhole packer is located downhole of the uphole packer and seals around the inner diameter surface of the wellbore. A pump is located within the wellbore, the pump having a pump intake in fluid communication with the wellbore downhole of the downhole packer and has a pump discharge in fluid communication with the wellbore between the uphole packer and the downhole packer. A motor is located within the wellbore uphole of the pump and provides power to the pump. A seal assembly is located between the motor and the pump. The pump, the motor and the seal assembly together form a submersible pump string. An uphole y-tool has an uphole y-tool first end in fluid communication with a production tubular and an uphole y-tool second end with two uphole y-tool branches, where a first uphole y-tool branch of the two uphole y-tool branches is in fluid communication with the wellbore and a second uphole y-tool branch of the two uphole y-tool branches is in fluid communication with a bypass tubular. A flow crossover has a fluid flow path from the wellbore between the uphole packer and the downhole packer and the first uphole y-tool branch.

In alternate embodiments, the bypass tubular can be positioned adjacent to the submersible pump string and extend between the uphole y-tool and the downhole packer. A central bypass axis of the bypass tubular can be aligned with an inner bore of the production tubular.

In other alternate embodiments, the system can further include a downhole y-tool, where the downhole y-tool is located downhole of the submersible pump string and uphole of the downhole packer. The downhole y-tool can have a downhole y-tool first end in fluid communication with the bypass tubular and a downhole y-tool second end with two downhole y-tool branches, where a first downhole y-tool branch of the two downhole y-tool branches is in fluid communication with the submersible pump string and a second downhole y-tool branch of the two downhole y-tool branches is in fluid communication with the bypass tubular. The downhole y-tool can have a plug seat with a seat surface facing in a direction towards the submersible pump string.

In yet other alternate embodiments, the downhole packer can be a single bore packer that circumscribes the production tubular. The downhole packer can alternately be a dual bore packer and the downhole packer can circumscribe the pump intake and the production tubular.

In another alternate embodiment of this disclosure, a method for providing artificial lift to wellbore fluids includes locating a pump within a wellbore, the pump oriented to selectively boost a pressure of the wellbore fluids traveling from the wellbore towards an earth's surface through a production tubular. A motor is located within the wellbore uphole of the pump and provides power to the pump. A seal assembly is positioned with a first side connected to the motor and a second side connected to the pump, where the pump, the motor and the seal assembly together form a submersible pump string. The production tubular uphole of the motor is circumscribed with an uphole packer. A downhole packer is located within the wellbore downhole of the pump. An uphole y-tool is provided that has an uphole y-tool first end in fluid communication with the production tubular and an uphole y-tool second end with two uphole y-tool branches, where a first uphole y-tool branch of the two uphole y-tool branches is mechanically connected to the submersible pump string and a second uphole y-tool branch of the two uphole y-tool branches is in fluid communication with a bypass tubular. The bypass tubular is positioned adjacent to the submersible pump string, the bypass tubular extending between the uphole y-tool and the downhole packer.

In alternate embodiments, a central bypass axis of the bypass tubular can be aligned with an inner bore of the production tubular. The bypass tubular can be circumscribed with the downhole packer and the downhole packer can be a single bore packer. A downhole y-tool can be provided. The downhole y-tool can be located downhole of the submersible pump string and uphole of the downhole packer. The downhole y-tool can have a downhole y-tool first end in fluid communication with the bypass tubular and a downhole y-tool second end with two downhole y-tool branches, where a first downhole y-tool branch of the two downhole y-tool branches is in fluid communication with the submersible pump string and a second downhole y-tool branch of the two downhole y-tool branches is in fluid communication with the bypass tubular.

In other alternate embodiments, a plug seat can be formed within the downhole y-tool with a seat surface facing in a direction towards the submersible pump string. A pump intake that is in fluid communication with the submersible pump string can be circumscribed with the downhole packer, where the downhole packer is a dual bore packer. A flow crossover can be located uphole of the motor and downhole of the uphole y-tool. The flow crossover can have a fluid flow path from the wellbore between the uphole packer and the downhole packer and the first uphole y-tool branch.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
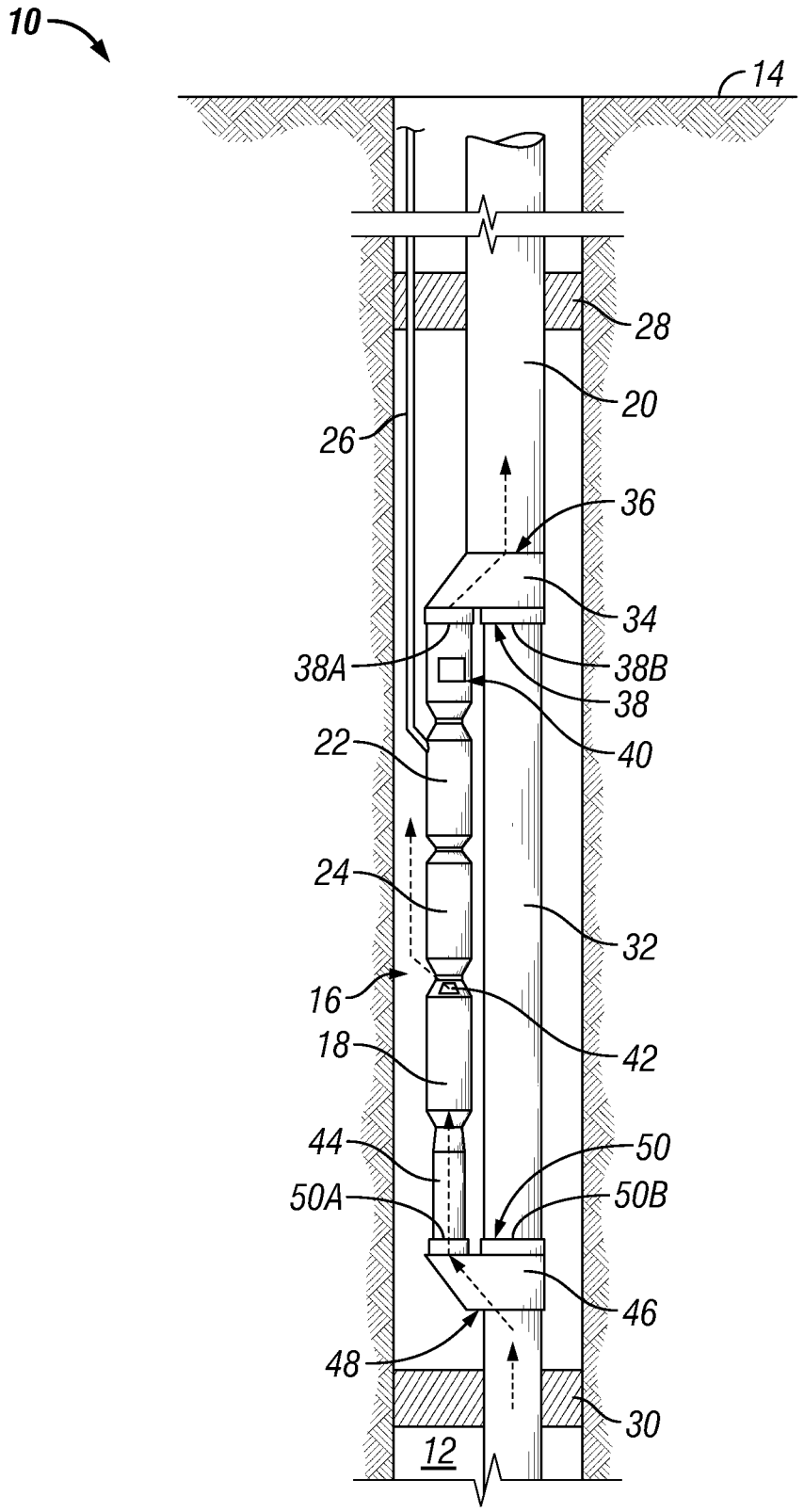
FIG. 1 is a schematic elevation view of an electric submersible pump system with a bypass system in accordance with an embodiment of this disclosure.

Looking at FIG. 1, well 10 can have wellbore 12 that extends to an earth's surface 14. Well 10 can be an offshore well or a land based well and can be used for producing hydrocarbons from subterranean hydrocarbon reservoirs. Submersible pump string 16 can be located within wellbore 12. As is discussed in this disclosure, submersible pump string 16 can provide artificial lift to wellbore fluids. Submersible pump string 16 can be an electrical submersible pump assembly and can include pump 18. Pump 18 can be, for example, a rotary pump such as a centrifugal pump. Pump 18 could alternatively be a progressing cavity pump, which has a helical rotor that rotates within an elastomeric stator or other type of pump known in the art for use with an electrical submersible pump assembly.

Pump 18 is located within wellbore 12 and is oriented to boost the pressure of the wellbore fluids traveling from the wellbore towards the earth's surface 14 so that wellbore fluids can travel more efficiently to the earth's surface 14 through production tubular 20. Production tubular 20 extends within wellbore 12 to carry wellbore fluids from downhole to the earth's surface 14.

Submersible pump string 16 can further include motor 22 and seal assembly 24. Motor 22 is also located within wellbore 12 and provides power to pump 18. Because embodiments of this disclosure provide for an inverted ESP, motor 22 is located uphole of pump 18. Seal assembly 24 is located between pump 18 and motor 22. Seal assembly 24 has a first side connected to motor 22 and a second side connected to pump 18. Seal assembly 24 seals wellbore fluid from entry into motor 22.

In the example embodiments power cable 26 extends alongside production tubular 20. Power cable 26 extends from the earth's surface 14 and is connected to motor 22 of submersible pump string 16. Power cable 26 can provide power to run motor 22. An advantage to having an inverted ESP system is having a reduced length of power cable 26 because motor 22 is uphole of pump 18. In slim wells, such as wells with a casing size of 5 inches or less, due to tight clearances, cable damage and failure during installation can be a contributor to reduced system reliability. Using an inverted ESP system also allows for alternative deployment options, such as a cable deployed ESP. In addition, having the motor uphole of the pump allows for an easier electrical connection being made to the motor than if the motor was downhole of the pump.

Uphole packer 28 can be used to isolate the wellbore 12 that is uphole of uphole packer 28 from the section of wellbore 12 that contains submersible pump string 16. Uphole packer 28 can circumscribe production tubular 20 uphole of motor 22 and can seal around an inner diameter surface of wellbore 12. Uphole packer 28 can be, for example, an ESP feed-thru packer. Uphole packer 28 can be a dual bore packer, with one bore of uphole packer 28 accommodating production tubular 20 and the second bore of uphole packer 28 accommodating an electrical penetration for power cable 26.

Downhole packer 30 can be located within wellbore 12 downhole of pump 18. Downhole packer 30 can be used to isolate the section of wellbore 12 that is downhole of downhole packer 30 from the section of wellbore 12 that contains submersible pump string 16. Downhole packer 30 can seal around the inner diameter surface of wellbore 12 and can circumscribe bypass tubular 32. In the embodiment of FIG. 1, downhole packer 30 is a single bore packer, with the single bore of downhole packer 30 accommodating bypass tubular 32. Downhole packer 30 can be, for example, a polished bore receptacle type of packer, allowing bypass tubular 32 to sting in.

Uphole y-tool 34 is located uphole of submersible pump string 16. Uphole y-tool 34 has an uphole y-tool first end 36 in fluid communication with production tubular 20. Uphole y-tool 34 has uphole y-tool second end 38 with two uphole y-tool branches, where first uphole y-tool branch 38A of the two uphole y-tool branches is in fluid communication with wellbore 12 and can be either directly or indirectly mechanically connected to submersible pump string 16. Second uphole y-tool branch 38B of the two uphole y-tool branches is in fluid communication with bypass tubular 32. Bypass tubular 32 is positioned adjacent to submersible pump string 16 and extends between uphole y-tool 34 and downhole packer 30.

Flow crossover 40 can be located uphole of motor 22 and downhole of the uphole y-tool 34. Flow crossover 40 can be located between motor 22 and first uphole y-tool branch 38A and can provide a fluid flow path from the portion of wellbore 12 that is located between uphole packer 28 and downhole packer 30, and first uphole y-tool branch 38A.

Pump 18 can include pump discharge 42 that discharges fluid that has passed through pump 18 into the portion of wellbore 12 that is located between uphole packer 28 and downhole packer 30. The fluid that passes out of pump discharge 42 can then pass by motor 22 to assist in cooling motor 22, and then enter uphole y-tool 34 by way of flow crossover 40 for delivery to surface 14 through production tubular 20. Pump 18 can further include pump intake 44 that is in fluid communication with wellbore 12 downhole of downhole packer 30. Pump intake 44 is also in fluid communication with submersible pump string 16 so that pump intake 44 provides a fluid flow path between wellbore 12 downhole of downhole packer 30 and submersible pump string 16.

Looking at FIG. 1, downhole y-tool 46 is located downhole of submersible pump string 16 and uphole of downhole packer 30. Downhole y-tool 46 has a downhole y-tool first end 48 in fluid communication with bypass tubular 32. Downhole y-tool 46 also has downhole y-tool second end 50 with two downhole y-tool branches. First downhole y-tool branch 50A of the two downhole y-tool branches is in fluid communication with submersible pump string 16. As an example, first downhole y-tool branch 50A can in fluid communication with submersible pump string 16 by way of pump intake 44 which can be mechanically connected to first y-tool branch 50A. Second downhole y-tool branch 50B of the two downhole y-tool branches is in fluid communication with bypass tubular 32.

In the embodiment of FIG. 1 where downhole packer 30 is a single bore packer, fluids from wellbore 12 downhole of downhole packer 30 enter bypass tubular 32 downhole of downhole packer 30. During production operations, such fluid is diverted through downhole y-tool 46 and into pump intake 44. After passing through pump 18, the fluid exits pump discharge 42 and into wellbore 12 between uphole packer 28 and downhole packer 30. The fluid can pass by motor 22 and into flow crossover 40. Flow crossover 40 can be mechanically connected to first uphole y-tool branch 38A so that fluid flowing into flow crossover 40 can be diverted by uphole y-tool 34 into production tubular 20 and produced to the surface.

Figure 2:
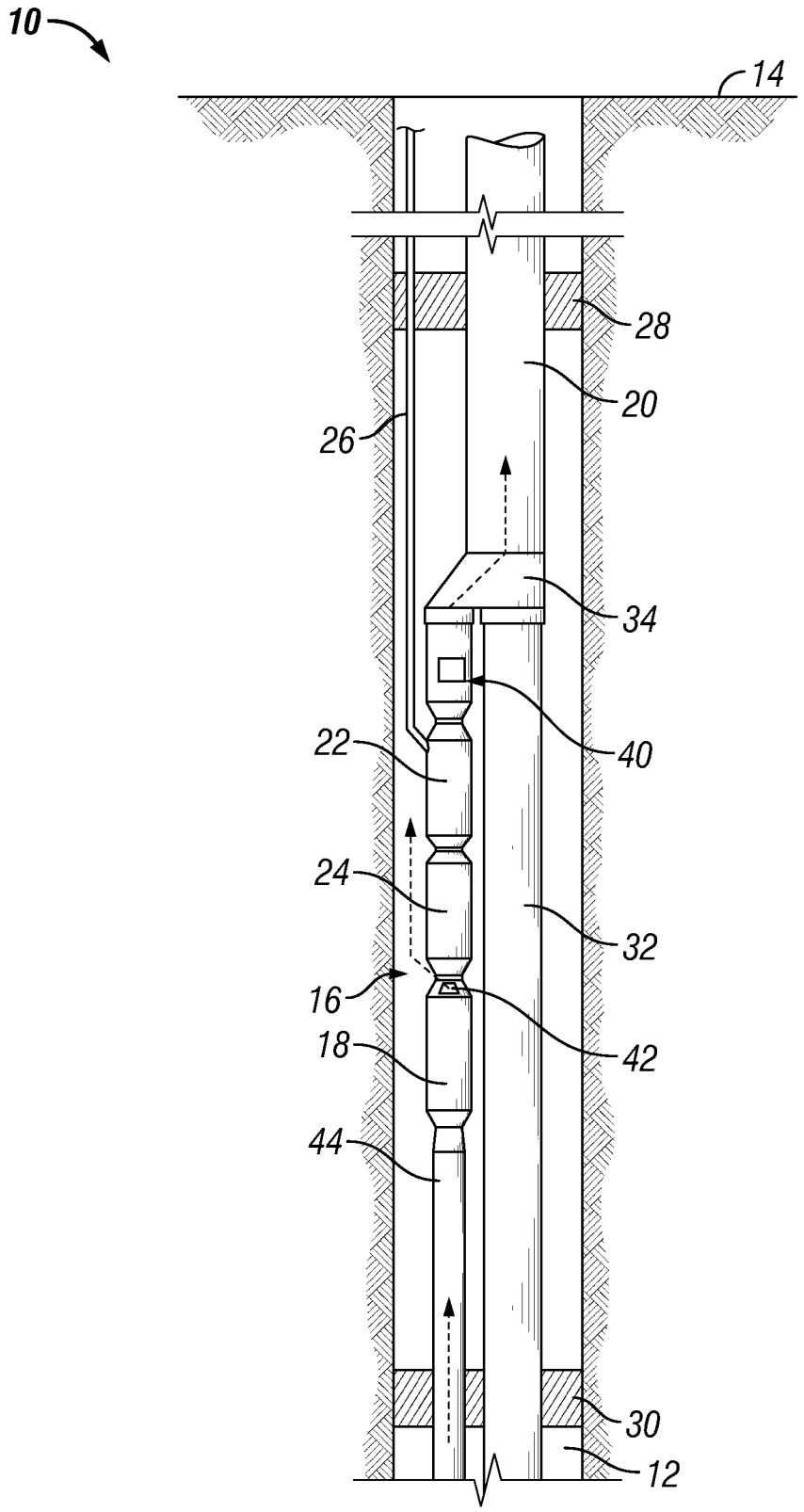
FIG. 2 is a schematic elevation view of an electric submersible pump system with a bypass system in accordance with an alternate embodiment of this disclosure.

Looking at FIG. 2, in alternate embodiments there may be no downhole y-tool. In such an embodiment, downhole packer 30 can be a dual bore packer. Downhole packer 30 can circumscribe both pump intake 44 and bypass tubular 32. In such an embodiment, fluids from wellbore 12 downhole of downhole packer 30 enter pump intake 44 downhole of downhole packer 30. During production operations, such fluid can pass through pump 18 and exit pump discharge 42 and into wellbore 12 between uphole packer 28 and downhole packer 30. The fluid can pass by motor 22 and into flow crossover 40. Flow crossover 40 can be mechanically connected to first uphole y-tool branch 38A so that fluid flowing into flow crossover 40 can be diverted by uphole y-tool 34 into production tubular 20 and produced to the surface.

Figure 3:
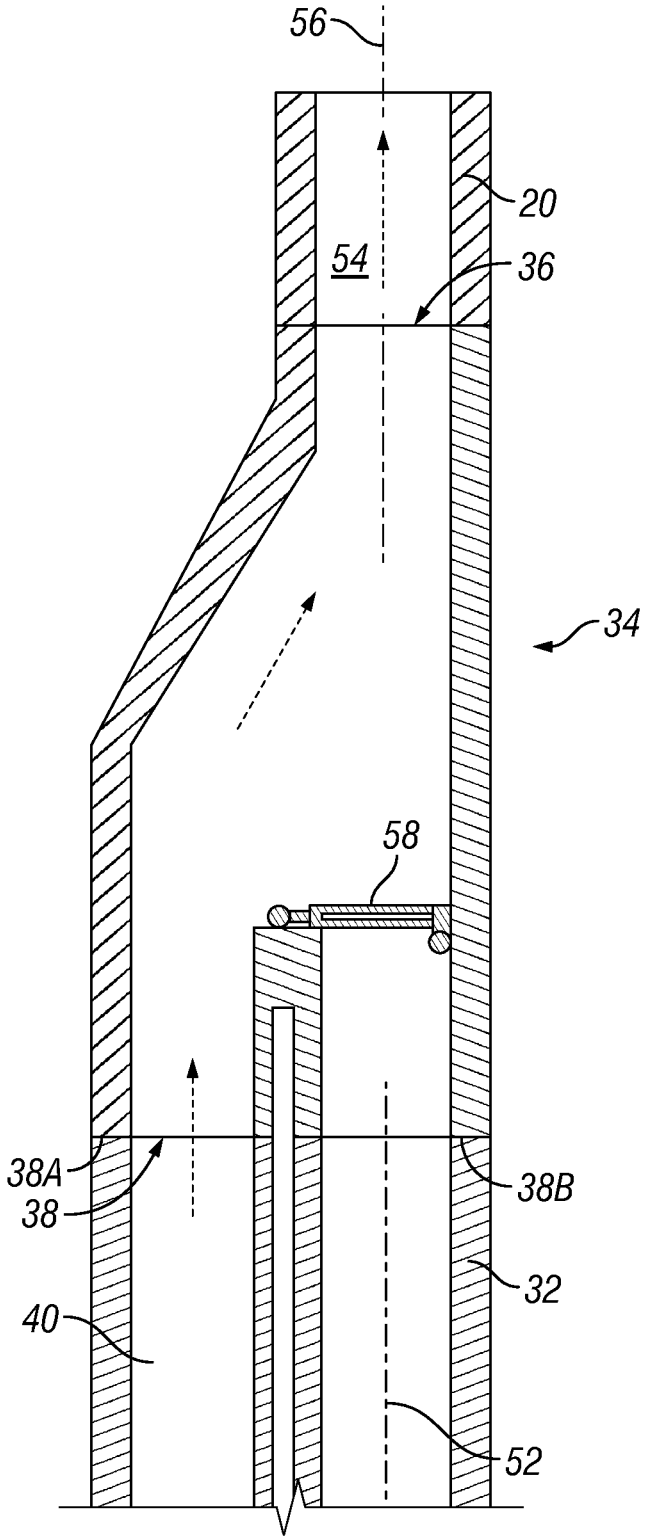
FIG. 3 is a schematic elevation view of an uphole y-tool in accordance with an embodiment of this disclosure.

FIG. 3 provides an example embodiment of uphole y-tool 34. In the example arrangement of uphole y-tool 34, central bypass axis 52 of bypass tubular 32 is aligned with an inner bore 54 of production tubular 20. In certain embodiments production tubular central axis 56 can be co-linear with central bypass axis 52 of bypass tubular 32. In other embodiments, production tubular central axis 56 can be offset from central bypass axis 52 of bypass tubular 32. Having inner bore 54 of production tubular 20 aligned with central bypass axis 52 of bypass tubular 32 allows for the deployment of logging, stimulation, or other tools down production tubular 20 and through bypass tubular 32 to reach wellbore 12 downhole of submersible pump string 16.

In order to direct fluids through submersible pump string 16 during production operations instead of through bypass tubular 32, the fluid flow path through bypass tubular 32 can be blocked. In the example of FIG. 3, diverter 58 can be operated by differential pressure to block and unblock a path through bypass tubular 32, as desired. As an example, diverter 58 can be a flapper with a spring that biases the flapper to a position that allows a path through bypass tubular 32 by way of second uphole y-tool branch 38B when pump 18 is off. When pump 18 is on, differential pressure forces will cause the flapper to close the path between production tubular 20 and bypass tubular 32, as shown in FIG. 3.

In order to run a tool through bypass tubular 32, pump 18 can be turned off and the flapper of diverter 58 will be moved by a spring to allow an open path between production tubular 20 and bypass tubular 32 so that tools can be run down production tubular 20 and through bypass tubular 32. Alternately, if logging or other operations are to take place while pump 18 is on, a flapper lock, logging plug that engages a plug seat, or other device can be used that can provide an open path from production tubular 20 and through bypass tubular 32.

Figure 4:
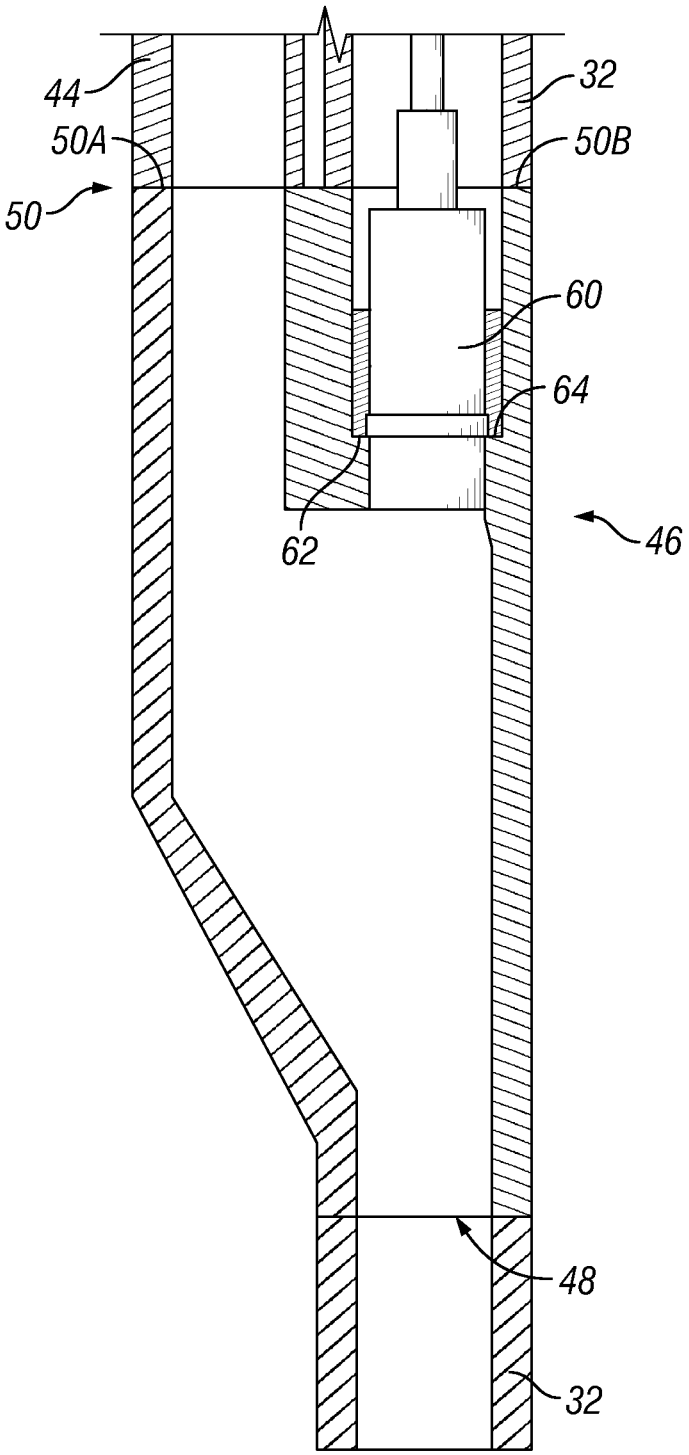
FIG. 4 is a schematic elevation view of a downhole y-tool in accordance with an embodiment of this disclosure.

Looking at FIG. 4, downhole y-tool 46 will have a letter "Y" shape. Plug 60 can be set with a wireline in second downhole y-tool branch 50B. Plug 60 can land on and engage plug seat 62 that has seat surface 64 that faces in an uphole direction towards submersible pump string 16 (FIG. 1). When set as shown in in FIG. 4, plug 60 will block the path between production tubular 20 and bypass tubular 32 so that fluid entering downhole y-tool 46 through downhole y-tool first end 48 will be blocked from passing through second downhole y-tool branch 50B and will instead be directed to first y-tool branch 50A and into pump intake 44. In order to lower tools through bypass tubular 32 downhole of submersible pump string 16, a wireline can be used to remove plug 60 from downhole y-tool 46.

In embodiments of this disclosure having both uphole y-tool 34 and downhole y-tool 46, either second uphole y-tool branch 38B or second downhole y-tool branch 50B of downhole y-tool 46 can be blocked so that fluid from wellbore 12 downhole of downhole packer is diverted through submersible pump string 16. It is possible, but not required, for both of second uphole y-tool branch 38B or second downhole y-tool branch 50B of downhole y-tool 46 to be blocked so that fluid from wellbore 12 downhole of downhole packer is diverted through submersible pump string 16.

In an example of operation and looking at FIG. 1, in order to provide artificial lift to wellbore fluids downhole packer 30 can be set within wellbore 12. Downhole packer 30 can be deployed in a cased section of wellbore 12 and have a polished bore. An upper completion assembly can then be lowered into wellbore 12. The upper completion assembly can include a seal stack, downhole y-tool 46, an inverted ESP assembly that includes inverted submersible pump string 16, bypass tubular 32, uphole y-tool 34, and uphole packer 28. The upper completion assembly can be lowered on and with production tubular 20. After stinging the upper completion into downhole packer 30, uphole packer 28 can be set.

In an alternate example of operation of FIG. 2, in order to provide artificial lift to wellbore fluids downhole a completion string can be deployed into wellbore 12. The completion string can include a dual bore downhole packer 30, an inverted ESP assembly that includes inverted submersible pump string 16, bypass tubular 32, uphole y-tool 34 and uphole packer 28. The completion string can be lowered on and with production tubular 20. After reaching the desired depth within wellbore 12, downhole packer 30 can be set, then uphole packer 28 can be set.

In the embodiments of FIGS. 1-2, during production operations, the path from production tubular 20 through bypass tubular 32 can be blocked with diverter 58 or plug 60. Blocking off the bypass tubular 32 will force wellbore fluids to go through pump intake 44. The fluids will be pumped and discharged from pump discharge 42 into wellbore 12 between uphole packer 28 an downhole packer 30. The fluids will then enter into the flow crossover 40, flow into production tubular 20 by way of uphole y-tool 34, and can be produced to the surface. In order to access wellbore 12 downhole of submersible pump string 16 with a tool, or for other access to wellbore 12 downhole of submersible pump string 16, diverter 58 can be opened or plug 60 can be removed, as applicable, without removing submersible pump string 16.

Embodiments described in this disclosure therefore provide systems and methods for bypassing an inverted ESP system to access the wellbore downhole of the ESP system with tools and perform operations downhole of the ESP system without having to pull the ESP from the well.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for providing artificial lift to wellbore fluids, the system having:

a pump located within a wellbore, the pump oriented to selectively boost a pressure of the wellbore fluids traveling from the wellbore towards an earth's surface through a production tubular;

a motor located within the wellbore uphole of the pump and providing power to the pump;

a seal assembly having a first side connected to the motor and a second side connected to the pump, where the pump, the motor and the seal assembly together form a submersible pump string;

an uphole packer circumscribing the production tubular uphole of the motor;

a downhole packer located within the wellbore downhole of the pump;

an uphole y-tool having an uphole y-tool first end in fluid communication with the production tubular and an uphole y-tool second end with two uphole y-tool branches, where a first uphole y-tool branch of the two uphole y-tool branches is mechanically connected to the submersible pump string and a second uphole y-tool branch of the two uphole y-tool branches is in fluid communication with a bypass tubular;

a downhole y-tool, where the downhole ytool is located downhole of the submersible pump string and uphole of the downhole packer, the downhole y-tool having a downhole y-tool first end in fluid communication with the bypass tubular and a downhole y-tool second end with two downhole y-tool branches, where a first downhole v-tool branch of the two downhole y-tool branches is in fluid communication with the submersible pump string and a second downhole y-tool branch of the two downhole y-tool branches is in fluid communication with the bypass tubular; and where the bypass tubular is positioned adjacent to the submersible pump string and extending between the uphole y-tool and the downhole packer.

2. The system of claim 1, where a central bypass axis of the bypass tubular is aligned with an inner bore of the production tubular.

3. The system of claim 1, where the second downhole y-tool branch of the downhole y-tool has a plug seat with a seat surface facing in a direction towards the submersible pump string.

4. The system of claim 1, where the downhole packer is a single bore packer.

5. The system of claim 1, further including a flow crossover located uphole of the motor and downhole of the uphole y-tool, the flow crossover having a fluid flow path from the wellbore between the uphole packer and the downhole packer to the first uphole y-tool branch.

6. A system for providing artificial lift to wellbore fluids, the system having:

an uphole packer sealing around an inner diameter surface of a wellbore;

a downhole packer located downhole of the uphole packer and sealing around the inner diameter surface of the wellbore;

a pump located within the wellbore, the pump having a pump intake in fluid communication with the wellbore downhole of the downhole packer, and having a pump discharge in fluid communication with the wellbore between the uphole packer and the downhole packer;

a motor located within the wellbore uphole of the pump and providing power to the pump;

a seal assembly located between the motor and the pump, where the pump, the motor and the seal assembly together form a submersible pump string;

an uphole y-tool having an uphole y-tool first end in fluid communication with a production tubular and an uphole y-tool second end with two uphole y-tool branches, where a first uphole y-tool branch of the two uphole y-tool branches is in fluid communication with the wellbore and a second uphole y-tool branch of the two uphole y-tool branches is in fluid communication with a bypass tubular;

a downhole y-tool, where the downhole y-tool is located downhole of the submersible pump string and uphole of the downhole packer, the downhole y-tool having a downhole y-tool first end in fluid communication with the bypass tubular and a downhole y-tool second end with two downhole y-tool branches, where a first downhole y-tool branch of the two downhole y-tool branches is in fluid communication with the submersible pump string and a second downhole y-tool branch of the two downhole y-tool branches is in fluid communication with the bypass tubular; and a flow crossover having a fluid flow path from the wellbore between the uphole packer and the downhole packer to the first uphole y-tool branch.

7. The system of claim 6, where the bypass tubular is positioned adjacent to the submersible pump string and extending between the uphole y-tool and the downhole packer, and where a central bypass axis of the bypass tubular is aligned with an inner bore of the production tubular.

8. The system of claim 6, where the downhole y-tool has a plug seat with a seat surface facing in a direction towards the submersible pump string.

9. The system of claim 6, where the downhole packer is a single bore packer that circumscribes the production tubular.

10. A method for providing artificial lift to wellbore fluids, the method including:

locating a pump within a wellbore, the pump oriented to selectively boost a pressure of the wellbore fluids traveling from the wellbore towards an earth's surface through a production tubular;

locating a motor within the wellbore uphole of the pump, the pump providing power to the pump;

positioning a seal assembly with a first side connected to the motor and a second side connected to the pump, where the pump, the motor and the seal assembly together form a submersible pump string;

circumscribing the production tubular uphole of the motor with an uphole packer;

locating a downhole packer within the wellbore downhole of the pump;

providing an uphole y-tool having an uphole y-tool first end in fluid communication with the production tubular and an uphole y-tool second end with two uphole y-tool branches, where a first uphole y-tool branch of the two uphole y-tool branches is mechanically connected to the submersible pump string and a second uphole y-tool branch of the two uphole y-tool branches is in fluid communication with a bypass tubular;

providing a downhole y-tool, where the downhole y-tool is located downhole of the submersible pump string and uphole of the downhole packer, the downhole y-tool having a downhole y-tool first end in fluid communication with the bypass tubular and a downhole y-tool second end with two downhole y-tool branches, where a first downhole v-tool branch of the two downhole y-tool branches is in fluid communication with the submersible pump string and a second downhole y-tool branch of the two downhole y-tool branches is in fluid communication with the bypass tubular; and positioning the bypass tubular adjacent to the submersible pump string, the bypass tubular extending between the uphole y-tool and the downhole packer.

11. The method of claim 10, further including aligning a central bypass axis of the bypass tubular with an inner bore of the production tubular.

12. The method of claim 10, further including circumscribing the bypass tubular with the downhole packer and where the downhole packer is a single bore packer.

13. The method of claim 10, further including forming a plug seat within the downhole y-tool with a seat surface facing in a direction towards the submersible pump string.

14. The method of claim 10, further including locating a flow crossover uphole of the motor and downhole of the uphole y-tool, the flow crossover having a fluid flow path from the wellbore between the uphole packer and the downhole packer and the first uphole y-tool branch.

* * * * *